US005821444A

United States Patent [19]

Yamaura

[11] Patent Number: 5,821,444

[45] Date of Patent: Oct. 13, 1998

[54] APPARATUS AND METHOD FOR TONE GENERATION UTILIZING EXTERNAL TONE GENERATOR FOR SELECTED PERFORMANCE INFORMATION

[75] Inventor: Atsushi Yamaura, Hamamatsu, Japan

[73] Assignee: Yamaha Corporation, Hamamatsu, Japan

[21] Appl. No.: 816,126

[22] Filed: Mar. 12, 1997

[30] Foreign Application Priority Data

Mar. 12, 1996 [JP] Japan ..... 8-083156

[51] Int. Cl.[6] ..... A63H 5/00; G04B 13/00; G10H 7/00

[52] U.S. Cl. ..... 84/609; 84/615; 84/645

[58] Field of Search ..... 84/609, 615, 645, 84/649, 653

[56] References Cited

U.S. PATENT DOCUMENTS 4,744,281 5/1988 Isozaki ..... 84/645 X
5,119,710 6/1992 Tsurumi .
5,345,035 9/1994 Yamada ..... 84/622
5,361,673 11/1994 Kira et al. ..... 84/645 X
5,414,209 5/1995 Morita ..... 84/645 X
5,616,878 4/1997 Lee et al. ..... 84/645

FOREIGN PATENT DOCUMENTS 07152370 6/1995 Japan .

*Primary Examiner*—William M. Shoop, Jr.
*Assistant Examiner*—Jeffrey W. Donels

[57] ABSTRACT

An electronic musical instrument is provided with a dedicated internal tone generator circuit and a removable external tone generator. When music performance information (e.g., MIDI data) of a plurality of tracks recorded on an external recording medium is to be introduced for reproduction by the musical instrument, one or more tracks capable of or suitable for reproduction by the electronic musical instrument are selected in accordance with a predetermined condition. The internal tone generator circuit generates a tone on the basis of the performance information of the selected tracks. The performance information of the other tracks that are not selected in the electronic musical instrument is sent to the external tone generator for audible reproduction thereby.

15 Claims, 4 Drawing Sheets

| FD Tr | DESTINATION | MIDI CH |
|---|---|---|
| 1 | Tr 1 | — |
| 2 | Tr 2 | — |
| 3 | MIDI I/F | 3 |
| 4 | MIDI I/F | 4 |
| 5 | MIDI I/F | 5 |
| 6 | MIDI I/F | 6 |
| | | |
| 15 | MIDI I/F | 15 |
| 16 | MIDI I/F | 16 |

| FD Tr | DESTINATION | MIDI CH |
|---|---|---|
| 1 | MIDI I/F | 1 |
| 2 | MIDI I/F | 2 |
| 3 | Tr 1 | — |
| 4 | MIDI I/F | 4 |
| 5 | Tr 2 | — |
| 6 | MIDI I/F | 6 |
| | | |
| 15 | MIDI I/F | 15 |
| 16 | MIDI I/F | 16 |

APPARATUS AND METHOD FOR TONE GENERATION UTILIZING EXTERNAL TONE GENERATOR FOR SELECTED PERFORMANCE INFORMATION

BACKGROUND OF THE INVENTION

The present invention relates generally to electronic musical instruments such as electronic pianos, and more particularly to electronic musical instruments which are designed to generate tones based on music performance information, namely, tone control information (e.g., MIDI data) received from a recording medium.

Among recent electronic musical instruments, electronic pianos have been produced that incorporate a floppy disk drive in the body thereof. With such a floppy disk drive, a user or human operator is allowed to record his or her actual performance on a floppy disk for subsequent reproduction to check the performance, and listen to famous music and good music performance recorded on commercially available music disk software. Using the software recorded performance, the user can also do various forms of piano lessons that would otherwise require another player, such as a duet and part-by-part lessons.

In these known electronic musical instruments, MIDI data are used as music performance information, namely, tone control information and data recorded on a floppy disk are also in the MIDI data format. Thus, in an actual music performance, the electronic musical instruments use the floppy disk drive to read out the recorded MIDI data from the floppy disk and control pitch, color and/or effect of tones to be generated in accordance with the read-out MIDI data.

Depending on the manufacturing costs and functions, some of the electronic musical instruments are capable of yielding dozens of different tone colors such as piano 1, piano 2, violin and flute and several different tonal effects such as detune, chorus and tremolo with only a small number of (say, two to four) tone colors simultaneously generatable thereby, while other electronic musical instruments are capable of yielding hundreds of different tone colors and dozens of different tonal effects with 16 to 32 tone colors simultaneously generatable thereby. Hereinbelow, the first-said electronic musical instruments will be collectively called a "less sophisticated instrument", while the second-said electronic musical instruments will be collectively called a "more sophisticated instrument".

However, the MIDI data recorded on the floppy disk include: data that can be used in common to the electronic musical instruments of practically every type, such as those relating to tone pitch (common MIDI data); and data that can be used only in the electronic musical instruments of a specific type, such as those relating to tone color or effect (non-common MIDI data). Thus, there would arise the problem that only the common MIDI data, of the MIDI data created by the more sophisticated instrument, can be read out and reproduced by the less sophisticated instrument and the non-common MIDI data can never be reproduced thereby. Further, where given commercially-available music disk software is designed only for the more sophisticated instrument capable of simultaneously generating 16 to 32 different tone colors, the less sophisticated instrument can reproduce not more than two to four tone colors of those preset in the software.

SUMMARY OF THE INVENTION

It is therefore an object of the present invention to provide an electronic musical instrument which, where its internal tone generator device is unable to reproduce a specific tone based on MIDI data read out from an external recording medium such as a floppy disk, allows an external tone generator device, connected thereto, to readily reproduce the specific tone without executing any particular setting process within the instrument.

In order to accomplish the above-mentioned object, the present invention provides an electronic musical instrument which comprises: a receiving device which receives music performance information of a plurality of tracks from an external source; a selecting device which selects the music performance information of one or more tracks, from among the music performance information of the plurality of tracks, that complies with a predetermined condition; a sending device which delivers, to an output of the electronic musical instrument, the music performance information of any of the tracks that is not selected by the selecting device; and a tone generating device which generates a tone on the basis of the music performance information of the one or more tracks that is selected by the selecting device.

A recording medium for use with the electronic musical instrument may be a floppy disk or the like storing therein music performance information or tone control information (e.g., MIDI data) of a plurality of tracks. The MIDI data recorded on the recording medium are read out by a readout device such as a floppy disk drive. The selecting device selects the MIDI data of one or more tracks, from among those of the plurality of tracks read out by the floppy disk drive, that complies with a predetermined condition. In a situation where the tone generating device in the electronic musical instrument is capable of yielding multiple sorts of high-quality piano tone colors but yielding other tone colors of just general sorts and quality, first and second ones of the plurality of tracks on the floppy disk may be selected as the predetermined condition, because ordinary commercially-available music software has MIDI data of piano tone colors recorded on the first and second tracks. In the case of a floppy disk with MIDI data recorded by a human operator, any of the tracks designated in advance by the operator may be selected as the predetermined condition. This way, the tone generating device generates a tone on the basis of the MIDI data of the one or more tracks selected by the selecting device. On the other hand, the MIDI data of any of the tracks that is not selected by the selecting device are output; in a case where a removable external tone generator is connected, the sent-out MIDI data are subjected to tone generating processing thereby. As a result, the MIDI data that can not be sounded by the body of the electronic musical instrument will be sounded by the external tone generator, while the MIDI data that can be sounded by the body of the electronic musical instrument will be sounded by the musical instrument alone.

Of the MIDI data of the tracks selected by the selecting device, some are better sounded by the tone generating device in the body of the musical instrument, rather than by the external tone generator. For example, this may apply to the case where the tone generating device is capable of yielding multiple sorts of high-quality piano tone colors but yielding other tone colors of just general sorts and quality as mentioned earlier, and where the tone colors of the tracks selected by the selecting device are not a piano tone color. According to the present invention, if the MIDI data of the selected tracks comply with a predetermined tonal characteristic condition (e.g., a piano tone color that is better sounded by the tone generating device in the body of the electronic musical instrument), they are sounded by the tone generating device; otherwise, the MIDI data may be sounded by the external tone generator.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figures 2, 5A, 5B:
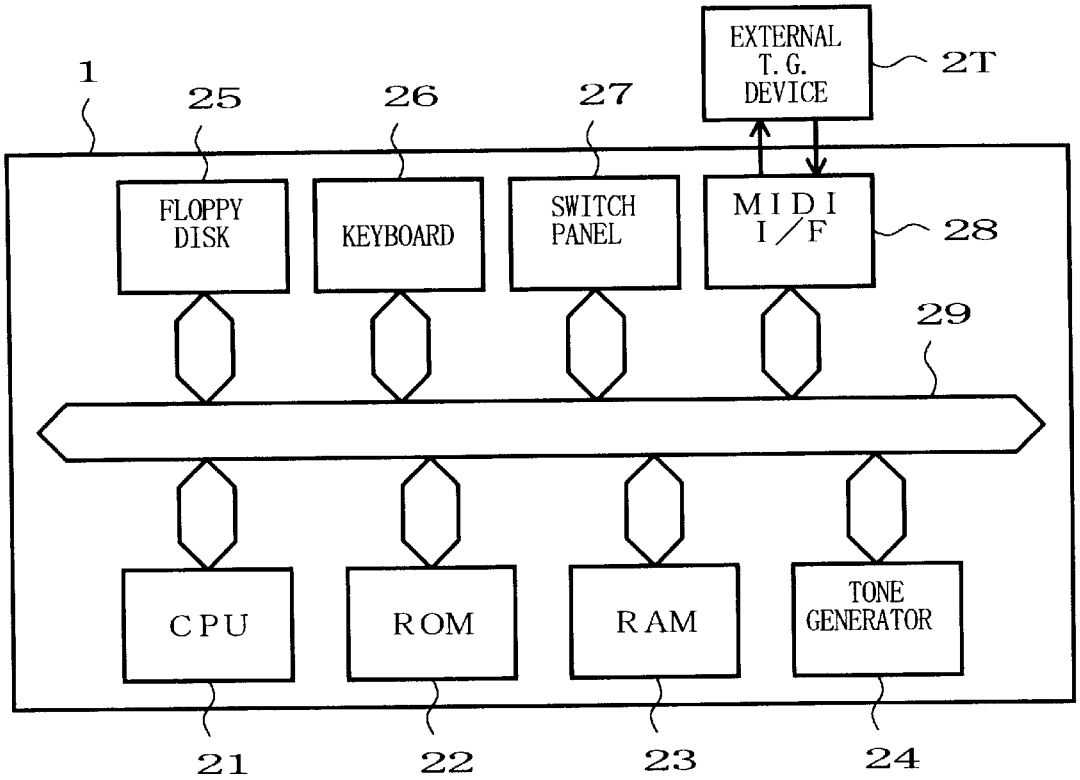
FIG. 2 is a block diagram illustrating a general hardware configuration of an electronic musical instrument according to the embodiment of the present invention.
FIGS. 5A and 5B show examples of output data destination tables indicating to which tone generator MIDI data of individual tracks read out from a floppy disk should be directed.

FIG. 2 is a block diagram illustrating a general hardware configuration of an electronic musical instrument according to an embodiment of the present invention. This electronic musical instrument 1 comprises a CPU 21, a ROM 22, a RAM 23, an internal tone generator (T.G.) 24, a floppy disk drive 25, a keyboard 26, a switch panel 27 and a MIDI interface (I/F) 28. In the illustrated example, an external tone generator device 2T of suitable construction is removably connected to the body of the electronic musical instrument 1 via the MIDI interface 28.

The CPU 21 controls overall operations of the electronic musical instrument 1, on the basis of various programs and data stored in the ROM 22 and RAM 23 as well as tone control information (MIDI data) read out via the floppy disk drive 25. Also, the CPU 21 delivers MIDI data to the external tone generator device 2T that is connected to the musical instrument 1 via the MIDI interface 28; that is, the CPU 21 supplies the internal tone generator 24 and external tone generator device 2T with the MIDI data read out via the floppy disk drive 25 and MIDI data created on the basis of the human operator's manual operation on the keyboard 26. In the instant embodiment, the electronic musical instrument 1 is capable of simultaneously generating two different tone colors, and two systems for generating tones of the two tone colors will hereinafter be referred to as a "first track Tr1" and a "second track Tr2". The instant embodiment will be described hereinbelow in relation to a case where the external tone generator device 2T is capable of simultaneously generating up to 16 different tone colors. Although not specifically shown here for simplicity, other peripherals, such as a timer, display and sound system, are connected to the CPU 21.

The ROM 22, which is a read-only memory, has prestored therein various programs and data for use by the CPU 21. The RAM 22 is provided in predetermined address areas of a random-access memory (RAM) for temporarily storing various data occurring as the CPU 21 runs the programs, and is used as registers, flags, buffers, tables, etc.

The tone generator 24 is capable of simultaneously generating a plurality of tone signals in a plurality of tone generating channels. Specifically, the tone generator 24 receives tone control information (i.e., MIDI data such as note-on data, note-off data, velocity data, pitch data and tone color number) given via the CPU 21, so as to generate tone signals on the basis of these received data. The resultant generated tone signals are supplied to the sound system (not shown) for audible reproduction or sounding. Note that the internal tone generator 24 has the capability of simultaneously yielding just two of dozens of different basic tone colors (e.g., those of pianos, violin, flute, etc.). In this embodiment, the internal tone generator 24 is capable of yielding piano tone colors of higher quality than those afforded by average standalone tone generators, but yielding tone colors of violin, flute, etc. of general sorts and quality.

To simultaneously generate tone signals in the plurality of tone generating channels as mentioned above, the internal tone generator 24 may be constructed in such a manner that the tone generating channels are implemented by using a single circuit on the time divisional basis or the tone generating channels are implemented by a plurality of discrete circuits on a one-to-one basis. Further, any tone signal generation method may be used in the tone generator 24 depending on a particular application intended. For example, any conventionally-known tone signal generation method may be used such as: the memory readout method where tone waveform sample value data stored in a waveform memory are sequentially read out in accordance with address data that change in correspondence to the pitch of tone to be generated; the FM method where tone waveform sample value data are formed by performing predetermined frequency modulation operations using the above-mentioned address data as phase angle parameter data; or the AM method where tone waveform sample value data are formed by performing predetermined amplitude modulation operations using the above-mentioned address data as phase angle parameter data. Other conventionally-known tone signal generation methods that may be used in the tone generator 24 include: the physical model method where a tone waveform is synthesized with algorithms simulatively describing the tone generating principle of a natural musical instrument; the harmonic synthesis method where a tone waveform is synthesized by adding harmonics to a fundamental wave; the formant synthesis method where a tone waveform is synthesized with a formant waveform having a specific spectral distribution; and the analog synthesizer method using a VCO (voltage controlled oscillator), VCF (voltage controlled filter) and VCA (voltage controlled amplifier). Further, the tone generator 24 may be implemented by a DSP and microprograms or the CPU and software programs, rather than by dedicated hardware circuitry.

Each tone signal generated by the tone generator 24 is audibly reproduced or sounded via the sound system including an amplifier and speaker (not shown). An effector may be provided between the tone generator 24 and the sound system.

The keyboard 26 has a plurality of keys for designating the pitch of each tone to be generated and key switches provided in corresponding relations to the keys. Upon detection of a new depressed key, the keyboard 26 outputs key-on event information including a key code corresponding to the depressed key, while upon detection of a new released key, it outputs key-off event information including a key code corresponding to the released key. In addition, the keyboard 26 generates touch data by determining the key depression velocity or force and outputs the generated touch data as velocity data. The keyboard 26 is employed here just because it is a fundamental performance operator which is easy to manipulate, but any other suitable performance operator may of course be employed in place of the keyboard 26.

The switch panel 27 comprises a plurality of operators or switches for selecting, setting and controlling the individual operational details of the electronic musical instrument 1. For example, the operators in the instant embodiment includes a track selection switch, a local control switch, and automatic performance start/stop switches, which will be later described in greater detail.

The MIDI interface 28 is an interface for supplying the external tone generator device 2T with tone control information, i.e., MIDI-standard-conforming data (MIDI data) such as note-on data, note-off data, key code, velocity data, program change number and effect number, and also for introducing MIDI data from the external tone generator device 2T into the body of the electronic musical instrument 1.

Unlike the internal tone generator 24 of the electronic musical instrument 1, the external tone generator device 2T is capable of yielding one hundred and dozens to hundreds of different tone colors and dozens of different tonal effects with 16 to 32 different tone colors simultaneously generatable thereby. However, the instant embodiment will be described hereinbelow in relation to a case where the internal tone generator 24 of the electronic musical instrument 1 is capable of yielding piano tone colors of more sorts and higher quality than those affordable by the external tone generator device 2T, but for other tone colors than the piano tone colors, the external tone generator device 2T is capable of yielding more sorts and higher quality. Further, while the following description will be made about the external tone generator device 2T as a MIDI instrument connected via the MIDI interface 28 to the body of the electronic musical instrument 1, another electronic musical instrument arranged in generally the same manner as the external tone generator device 2T or containing a tone generator of the same level as the tone generator 24 may of course be connected to the body of the electronic musical instrument 1.

Next, with reference to flowcharts of FIGS. 1, 3 and 4, a description will be made hereinbelow about an exemplary manner in which the electronic musical instrument 1 of FIG. 2 supplies MIDI data to the external tone generator device 2T.

Figure 1:
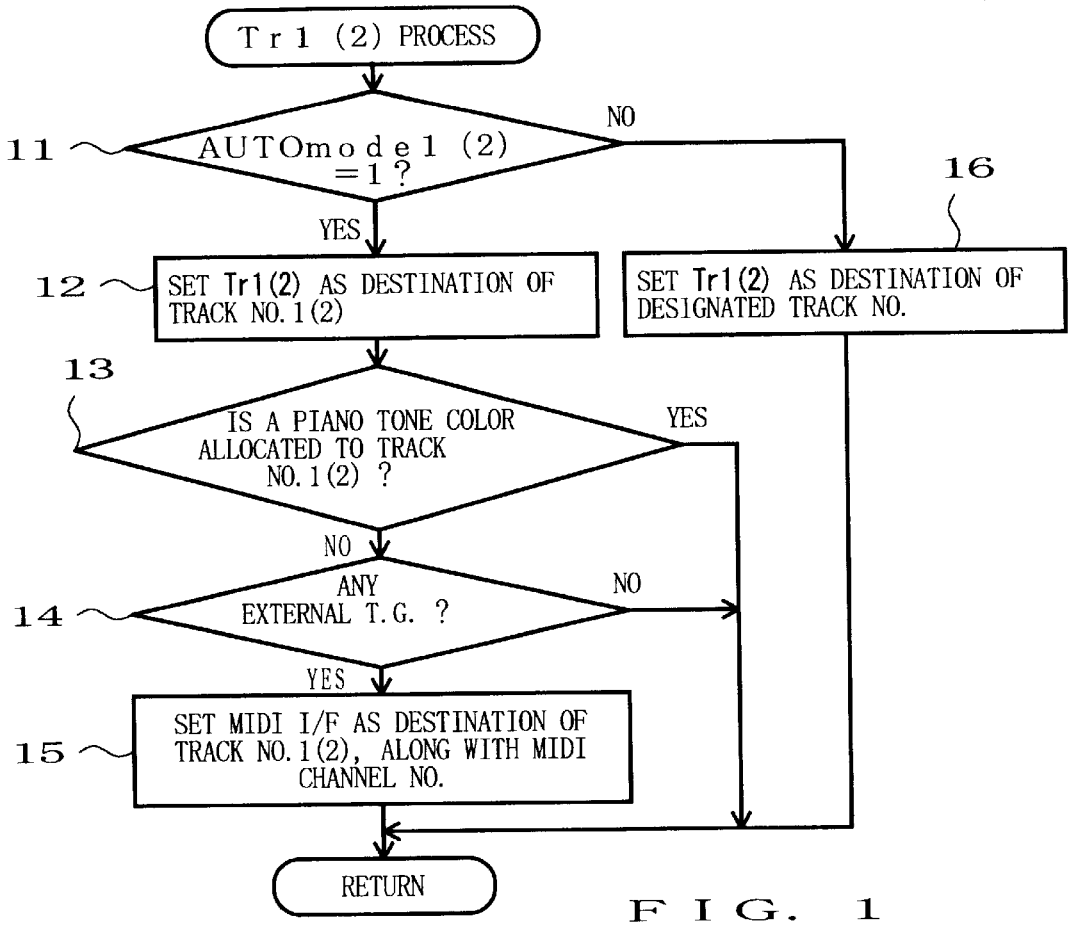
FIG. 1 is a flowchart illustrating an example of a "first track Tr1 process" (and "second track Tr2 process") executed in one embodiment of the present invention.
Figure 4:
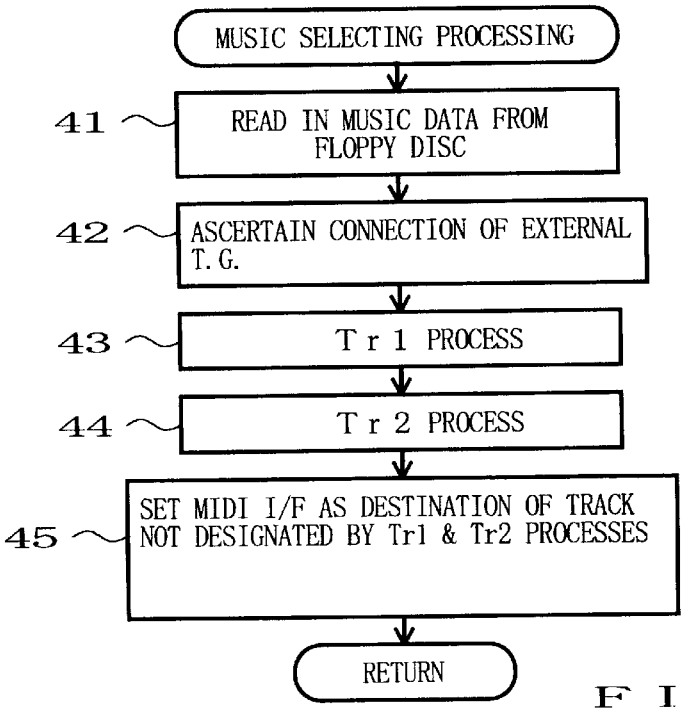
FIG. 4 is a flowchart illustrating an example of music selecting processing which is executed in panel event processing of the main routine in response to activation of a track selecting switch.
Figure 3:
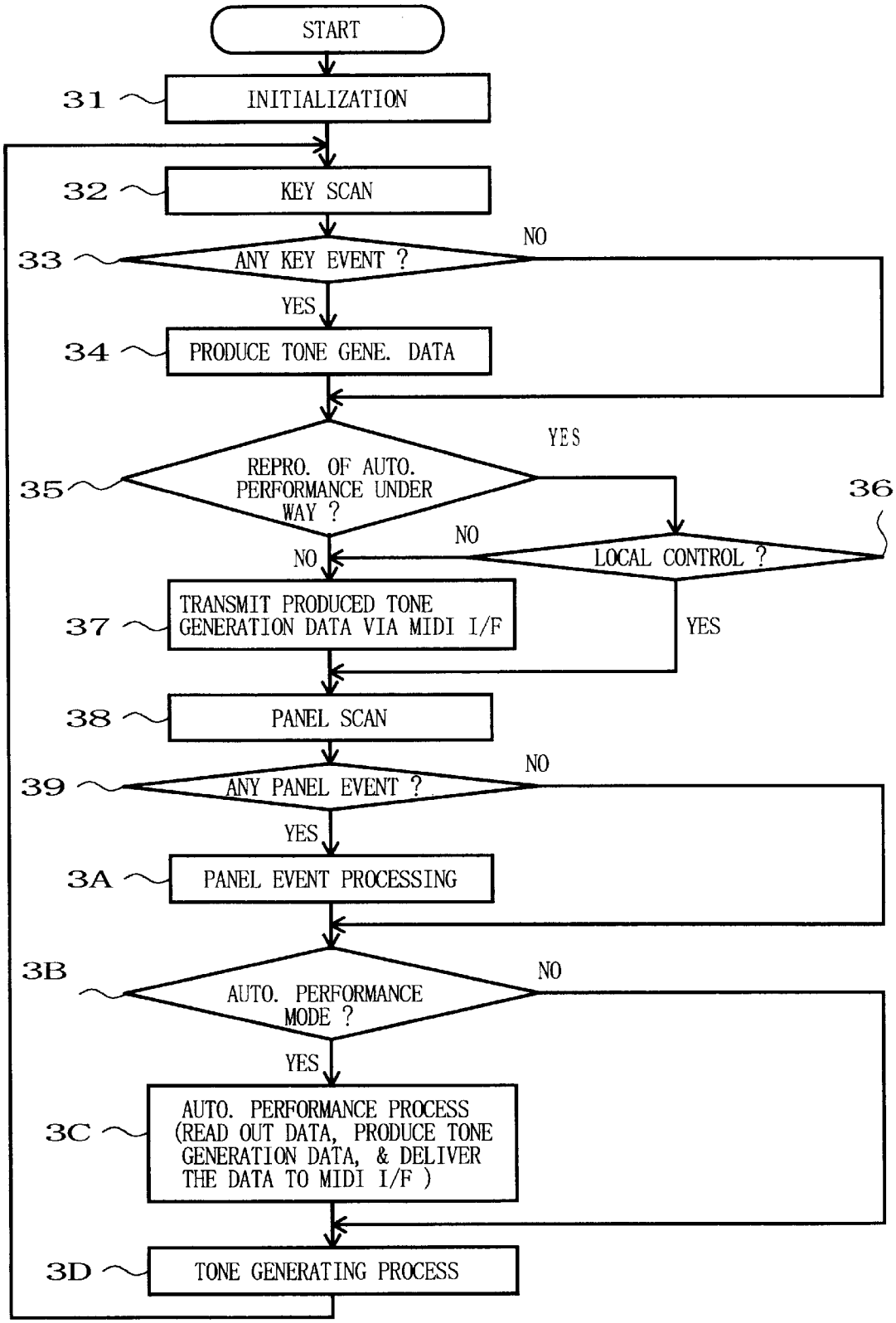
FIG. 3 is a flowchart illustrating a main routine executed by the electronic musical instrument of FIG. 2.

FIGS. 1, 3 and 4 are flowcharts of various processing executed by the electronic musical instrument 1; more specifically, FIG. 3 shows an example of a main routine initiated upon power-on of the musical instrument 1, FIG. 4 is an example of music selecting processing in panel event processing that is executed at step 3A of FIG. 3 in response to activation of a track selecting switch on the switch panel 27 of FIG. 4, and FIG. 1 illustrates detailed examples of a "first track Tr1 process" and "second Tr2 process" in the music selecting switch processing.

In the main routine of FIG. 3, an initialization process is executed at step 31 upon power-on of the electronic musical instrument 1, where among others, auto. mode flags AUTOmode1 and AUTOmode2 are both set to a high level "1". After the initialization process of step 31, the main routine repetitively executes a "key scan process" of step 32, a "panel scan process" of step 38 and a tone generating process of step 3D in a steady loop. Other processes of steps 34, 37, 3A and 3C are or are not effected depending on results at respective preceding determination steps.

The following paragraphs describe operations taking place when the user or human operator depresses a key on the keyboard 26. In this case, a key-on event corresponding to the depressed key is detected through the key scan process of step 32, and next step 33 determines that a key event has occurred (YES), so that tone generation data, i.e., MIDI data (key code and velocity data) corresponding to the depressed key are generated at step 34. Then, the tone generating process of step 3D causes the internal tone generator 24 to generate a tone corresponding to the depressed key.

At step 35, it is determined as to whether the electronic musical instrument 1 is currently executing reproduction of an automatic performance based on MIDI data supplied from the floppy disk drive 25. If the reproduction of such an automatic performance is not under way (NO), the main routine proceeds to step 37. If, on the other hand, the reproduction of such an automatic performance is under way as determined at step 35, then a further determination is made at step 36 as to whether a local control switch is currently in an "ON" state. If the local control switch is currently "OFF" as determined at step 36, the main routine proceeds to step 37.

At step 37, the tone generation data produced at step 34 are transmitted to the outside via the MIDI interface 28. In the case where the external tone generator device 2T is connected to the interface 28 as shown in FIG. 2, the internal tone generator 24 generates a tone based on the tone generation data through the tone generating process of step 3D, and at the time, the external tone generator device 2T generates a tone based on tone generation data corresponding to the MIDI data transmitted via the MIDI interface 28. Namely, tones corresponding to the tone generation data produced at step 34 are generated by both the internal tone generator 24 and the external tone generator device 2T.

However, the tone generating process of step 37 is not executed if the local control switch is currently "OFF" as determined at step 36. That is, when the keyboard 26 has been operated during the reproduction of the automatic accompaniment, the non-activation (OFF) or activation (ON) of the local control switch determines whether the corresponding MIDI data should be transmitted to the outside or used only in the body of the electronic musical instrument 1 without being transmitted to the outside. Thus, when the the local control switch is OFF, the tone generation data are transmitted via the MIDI interface 28 to the external tone generator device 2T (which may be another MIDI instrument) so that the tone generating process is effected in the external tone generator device 2T with no such process executed in the internal tone generator 24. Conversely, when the the local control switch is ON, the tone generating process responsive to the operation of the keyboard 26 is executed only in the electronic musical instrument 1.

The following paragraphs describe operations taking place when the automatic performance start switch (not shown) is activated on the switch panel 27 with a floppy disk inserted in the floppy disk drive 25. In this case, step 39 determines that a panel event has occurred on the panel 27, so that panel event processing is executed at step 3A. In this panel event processing, the auto. performance flag is set to a high level "1" so as to indicate that an automatic performance is currently under way and the music selecting processing of FIG. 4 is executed as will be more fully described later. Conversely, when the automatic performance stop switch (not shown) is activated on the switch panel 27, the auto. performance flag is set to a low level "0" so as to indicate that an automatic performance is not currently under way.

Once the auto. performance flag is set to the high level "1" at step 3A, step 3B determines that an automatic performance is currently under way (YES), so that an automatic performance process is carried on at next step 3C. In the automatic performance process of step 3C, the floppy disk drive 25 is driven to read out therefrom music software or performance data previously recorded by the human operator, and tone generation data are produced on the basis of the read-out data. The thus-produced tone generation data are then passed to the internal tone generator 24 and also to the external tone generator device 2T via the MIDI interface 28, on the basis of output data destination tables as shown in FIGS. 5A and 5B.

FIGS. 5A and 5B show examples of such output data destination tables. The output data destination table of FIG. 5A is the one automatically set when the auto. performance flag is at the high level "1", while the output data destination table of FIG. 5B is the one set when the human operator operates the switch panel 27 to designate a specific one of the track numbers, in the floppy disk, from which data should be reproduced. Each of the output data destination tables defines destinations in corresponding relations to the individual numbers of tracks in the floppy disk; in the illustrated example, the floppy disk contains a total of 16 tracks.

When the destination of the tone generation data is the internal tone generator 24, "Tr1" and "Tr2" respectively indicative of the first and second tracks in the internal tone generator 24 are set in the "destination" column of the output data destination table. When the destination of the tone generation data is the external tone generator device 2T, "MIDI I/F" indicative of the MIDI interface 28 is set in the "destination" column of the destination table. Further, when the output data destination of the tone generation data is the external tone generator device 2T, its MIDI channel No. is set in the "MIDI CH" column of the destination table.

The output data destination table of FIG. 5A is set in such a manner that tone generation data of track No. 1 will be directed to the first track Tr1 of the internal tone generator 24, tone generation data of track No. 2 will be directed to the second track Tr2 of the tone generator 24 and tone generation data of other track Nos. 3–16 will be directed to the external tone generator device 2T via the MIDI interface 28. The output data destination table of FIG. 5B is set in such a manner that tone generation data of track No. 3 will be directed to the first track Tr1 of the internal tone generator 24, tone generation data of track No. 5 will be directed to the second track Tr2 of the tone generator 24 and tone generation data of other track Nos. 1, 2, 4 and 6–16 will be directed to the external tone generator device 2T via the MIDI interface 28.

MIDI channels for the tone generation data sent out via the MIDI interface 28 are set to correspond in number to the respective track numbers. Setting of the output data destination tables is effected through the music selecting processing of FIG. 4.

The music selecting processing of FIG. 4 will be described in detail hereinbelow.

First, a description will be made about operations taking place when the automatic performance start switch (not shown) is activated on the switch panel 27 with a floppy disk inserted in the floppy disk drive 25. Once the automatic performance start switch is activated, an affirmative (YES) determination results at step 39, i.e., step 39 determines that a panel event has occurred, so that the music selecting processing of FIG. 4 is executed in the panel event processing. First, in the music selecting processing, step 41 reads in music data, such as data indicative of the number of tracks and tone colors allocated to the individual tracks, written in the header section of the floppy disk. Then, at step 42, it is ascertained whether the external tone generator 24 is connected to the MIDI interface 28. If so, external tone generator connection flag ET is set to a high level "1"; otherwise, the connection flag ET is set to a low level "0". This tone generator connection flag ET is used in the "first track Tr1 (2)" processing of FIG. 1. Then, a decision is made as to which of the tracks of the floppy disk should be assigned to the first and second tracks Tr1 and Tr2; that is, the "first track Tr1 process" of step 43 and "second track Tr2 process" of step 44 are executed to prepare the output data destination tables.

The "first track Tr1 process" and "second track Tr2 process" are basically the same, and this is why the "second track Tr2 process" is indicated by just a parenthesized number "(2)" in FIG. 1. Thus, for example, the operational contents written in the block of step 12 should read "set the destination of data of track No. 1 to Tr1" in the case of the "first track Tr1 process", but should read "set the destination of data of track No. 2 to Tr2" in the case of the "second track Tr2 process".

In the "first track Tr1 process", a determination is first made at step 11 as to whether the auto. mode flag AUTOmode1 is currently at the high level "1". With an affirmative answer, the process proceeds to next step 12, while with a negative answer, the process branches to step 16. Since the auto. mode flag AUTOmode1 has been set to "1" in the initialization of step 31 of FIG. 3, it remains at the high level "1" unless the human operator activates the track selecting switch (not shown) on the switch panel 28 to instruct which of the tracks of the floppy disk should be sounded in the first track Tr1 of the musical instrument 1.

Thus, if the human operator has not activated the track selecting switch in order to instruct reproduction from a desired one of the tracks, operations of steps 12 to 15 are executed; otherwise, an operation of step 16 is executed. More specifically, if the human operator has not instructed reproduction from any one of the tracks, the process proceeds to step 12 where the first track Tr1 of the internal tone generator 24 is set, in the output destination table, as the destination of track No. 1 of the floppy disk. Then, at step 13, a determination is made as to whether the tone color allocated to track No. 1 of the floppy disk is a piano tone color. If so (YES), the process proceeds to the "second track Tr2 process" of step 44. If, on the other hand, the tone color allocated to track No. 1 at step 13 is other than piano tone colors (NO), then the process moves on to step 14.

At step 14, a determination is made as to whether the current value of the external tone generator connection flag ET having been set at step 42 is "1", i.e., whether or not the external tone generator is currently connected to the electronic musical instrument 1. If answered in the affirmative at step 14, the process goes to next step 15, where the external tone generator device, i.e., "MIDI I/F" is set, in the output destination table, as the destination of track No. 1 of the floppy disk, along with a MIDI channel number corresponding to the track number. On the other hand, if answered in the negative at step 44, the process proceeds directly to the "second track Tr2 process" of step 44.

The reason why it is determined at step 13 whether the tone color allocated to track No. 1 of the floppy disk is a piano tone color is that the internal tone generator 24 is designed to be able to afford high-quality piano tone colors of multiple sorts and hence it is desirable that the necessary tone generating process for the piano tone colors be executed by the internal tone generator 24. However, for other tone colors than the piano tone colors, it is desirable that the external tone generator device 2T, if connected at all, execute the necessary tone generating process, because the internal tone generator 24 is capable of executing just the basic sorts of piano tone colors.

In the "second track Tr2 process" of step 44, there are executed the same operations, as in the above-described "first track Tr1 process", for track No. 2.

Then, at step 45, the external tone generator device, i.e., "MIDI I/F" is set, in the output destination table, as the respective destinations of track Nos. 3–16 of the floppy disk, along with MIDI channel numbers corresponding to the track numbers.

As a result of the operations as described above, the output data destination will be set as shown in FIG. 5A if piano tone colors are allocated to both track No. 1 and track No. 2 of the floppy disk. If, however, the tone color allocated to either or both of track No. 1 and track No. 2 of the floppy disk is not a piano tone color, data similar to those of other track numbers 3–16 will be set in the "destination" and "MIDI CH" columns.

The following operations take place when the human operator has instructed reproduction of a desired one of the tracks. Consider a case where the operator has instructed that tracks Nos. 3 and 5 of the floppy disk be reproduced in the first and second tracks, respectively, of the internal tone generator 24. In this case, the operation of step 16 is executed in the "first track Tr1 process" so that the first track "Tr1" of the internal tone generator 24 is set as the output data destination of designated track No. 3 of the floppy disk, and in the "second track Tr2 process" so that the second track "Tr2" of the internal tone generator 24 is set as the output data destination of designated track No. 5 of the floppy disk. After this, operation of step 45 is executed so that the output data destination will be created as shown in FIG. 5B.

While the internal tone generator 24 in the instant embodiment has been described above as having high-quality preset piano tone colors, the principle of the present invention may of course be applied to an electronic musical instrument where the internal tone generator 24 has high-quality preset tone colors of stringed or percussion instruments. Further, while the embodiment has been described in relation to a single tone color, the present invention may be applied to an electronic musical instrument which has various high-quality preset tone colors. In this case, it is only necessary that the determination operation of step 13 be conducted on the various tone colors.

Figure 6:
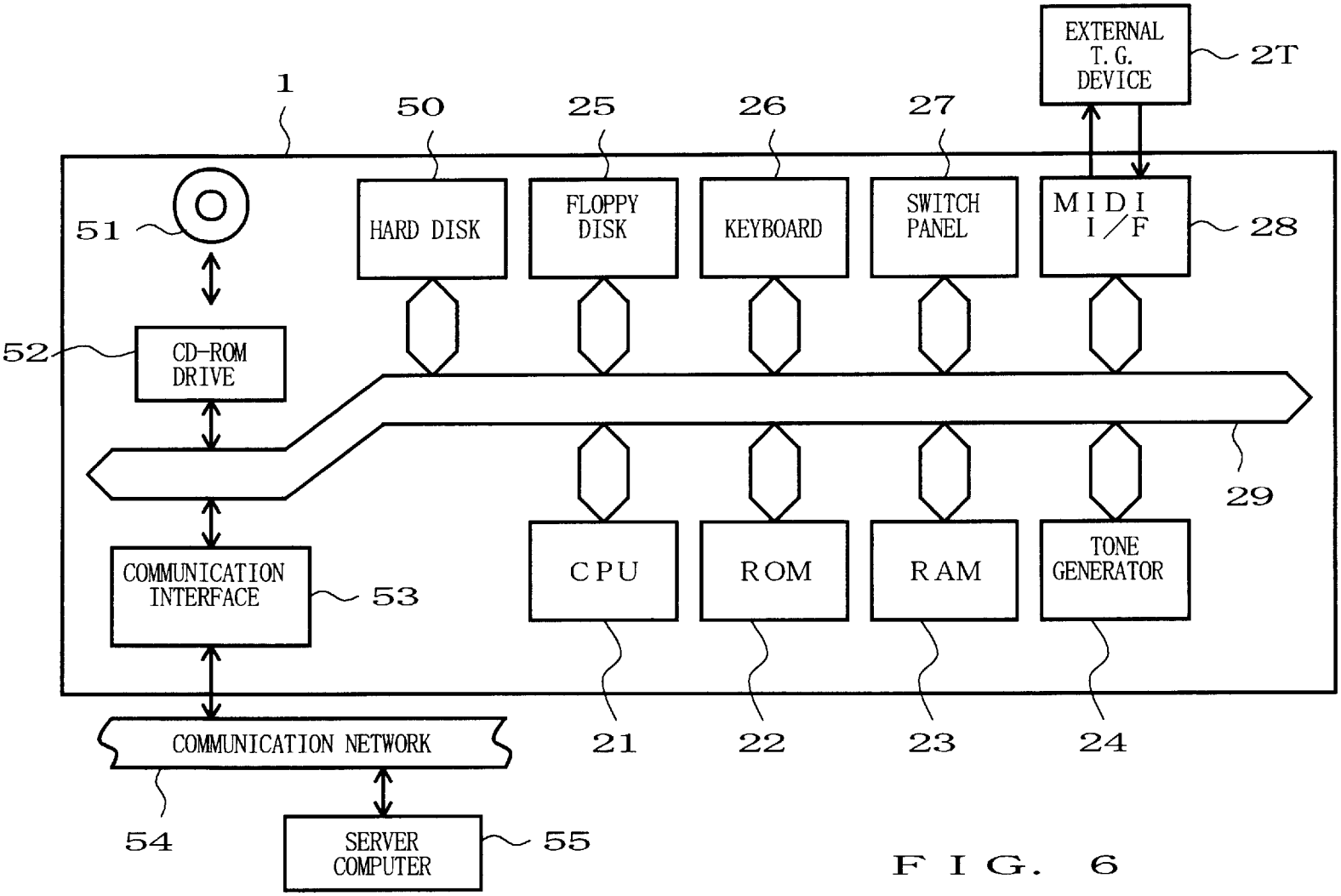
FIG. 6 is a block diagram showing another example of hardware configuration of the electronic musical instrument of the present invention.

FIG. 6 shows a modification of the embodiment of FIG. 2, where the same reference characters as in FIG. 2 represent the same elements as in the figure. As shown, a hard disk 50 is provided, and by prestoring the operating program in the hard disk 50 of FIG. 6 rather than in the ROM 22 and loading the operating program into the RAM 23, the CPU 21 can operate in exactly the same way as where the operating program is stored in the ROM 22. This greatly facilitates version-up of the operation program, addition of an operating program, etc. In the hard disk 50, there may be stored various other data than an operating program, such as waveform data corresponding to the individual tone colors, automatic performance data and chord progression data. A CD-ROM (compact disk) 51 may be used as a removably-attachable external recording medium for recording various data such as automatic performance data, chord progression data and tone waveform data and an optional operating program, as mentioned above. Such an operating program and data stored in the CD-ROM 51 can be read out by a CD-ROM drive 52 to be then transferred for storage in the hard disk 50. This facilitates installation and version-up of the operating program. The external recording medium for storing the operating program may be other than the CD-ROM, such as a floppy disk and magneto optical disk (MO).

A communication interface 53 may be connected to the bus 29 so that the electronic musical instrument 1 can be connected via the interface 53 to a communication network 54 such as a LAN (local area network), internet and telephone line network and can also be connected to an appropriate sever computer 55 via the communication network 54. Thus, in a situation where the operating program and various data are not contained in the hard disk 50, these operating program and data can be received from the server computer 55 and downloaded into the hard disk 50. In such a case, the electronic musical instrument 1, as a "client", sends a command requesting the server computer 55 to download the operating program and various data by way of the communication interface 53 and communication network 54. In response to the command, the server computer 55 delivers the requested operating program and data to the electronic musical instrument 1 via the communication network 54. The electronic musical instrument 1 completes the necessary downloading by receiving the operating program and data via the communication network 54 and storing these into the hard disk 50.

It should also be understood here that the electronic musical instrument 1 may be implemented by installing the operating program and various data corresponding to the present invention in a commercially available personal computer. In such a case, the operating program and various data corresponding to the present invention may be provided to users in a recorded form on a recording medium, such as a CD-ROM or floppy disk, which is readable by the personal computer. Where the personal computer is connected to a communication network such as a LAN, the operating program and various data may be supplied to the personal computer via the communication network similarly to the above-mentioned.

Of course, the characteristic control of the present invention may be implemented by use of dedicated hardware circuitry as well as by execution of a software program as in the above-described embodiment.

Furthermore, while the embodiment has been described above in relation to a case where MIDI data are recorded on a floppy disk, they may be recorded on any other recording medium, such as a MO (magneto optical) disk or IC card. Rather than being recorded on the recording medium, these MIDI data may be supplied to the electronic musical instrument from an external communication circuit via the MIDI interface. Moreover, a plurality of external tone generator devices, rather than just one external tone generator device, may be connected to the electronic musical instrument of the present invention.

It should also be noted that the term "electronic musical instrument" as used in relation to the present invention should be comprehensively interpreted to refer to not only apparatuses, such as keyboard-type electronic musical instruments, having performance operators and functioning as dedicated musical instruments, but also other apparatuses, such as automatic performance devices like sequencers, tone generator modules and karaoke devices, having no performance operators but functioning as dedicated musical instruments or information processors. The term "electronic musical instrument" should also be interpreted as referring to other apparatuses which do not always function as dedicated musical instruments or information processors but can virtually function as dedicated musical instruments or information processors depending on necessary program settings, such as the ones that can virtually function as dedicated musical instruments by running necessary tone generating and/or tone information processing programs on a general-purpose computer such as a personal computer or a multi-function game computer.

With the arrangements having been described so far, the electronic musical instrument of the present invention accomplishes the superior benefits that where its internal tone generator device is unable to reproduced a tone based on MIDI data read out from an external recording medium such as a floppy disk, allows an external tone generator device to readily reproduce the tone without executing any particular setting process within the musical instrument.

What is claimed is:

1. An electronic musical instrument comprising:

a receiving device which receives music performance information of a plurality of tracks from an external source;

a selecting device which selects the music performance information of one or more said tracks, from among the music performance information of said plurality of tracks, that complies with a predetermined condition;

a sending device which delivers, to an output of said electronic musical instrument, the music performance information of any of the tracks that is not selected by said selecting device; and a tone generating device which generates a tone on the basis of the music performance information of the one or more tracks that is selected by said selecting device.

2. An electronic musical instrument as claimed in claim 1 which further comprises an external tone generator device removably connected to said sending device and wherein said external tone generator device generates a tone on the basis of the music performance information of any of the track that is not selected by said selecting device.

3. An electronic musical instrument as claimed in claim 1 wherein a desired track number is automatically designated as said predetermined condition, and said selecting device selects the performance information of one of the tracks that corresponds to the designated track number.

4. An electronic musical instrument as claimed in claim 1 wherein a desired track number is designated, as said predetermined condition, by a human operator, and said selecting device selects the performance information of one of the tracks that corresponds to the designated track number.

5. An electronic musical instrument as claimed in claim 1, wherein said predetermined condition relates to whether the music performance information includes a tonal characteristic that can be generated by a tone generating function possessed by said tone generating device.

6. An electronic musical instrument as claimed in claim 1 wherein said receiving device includes a device to which is removably attached a recording medium storing therein the music performance information of the plurality of tracks, and a readout device that reads out said music performance information of the plurality of tracks from said recording medium.

7. An electronic musical instrument as claimed in claim 1 wherein said music performance information is information complying with a MIDI standard.

8. An electronic musical instrument comprising:

a receiving device which receives music performance information of a plurality of tracks from an external source;

a first selecting device which selects one or more of the tracks whose music performance information is received by said receiving device, in accordance with a first predetermined condition;

a second selecting device which further selects one or more of said tracks selected by said first selecting device, in accordance with a second predetermined condition;

a sending device which delivers, to an output of said electronic musical instrument, the music performance information of any of the tracks that is not selected by said first selecting device and the music performance information of any of the tracks that is not selected by said second selecting devices; and a tone generating device which generates a tone on the basis of the music performance information of said one or more tracks selected by said second selecting device.

9. An electronic instrument as claimed in claim 8 wherein said first predetermined condition relates to track numbers of one or more said tracks to be selected, and said second predetermined condition relates to one or more said tracks to which is allocated the music performance information relating to a tonal characteristic that can be generated by a tone generating function possessed by said tone generating device.

10. An electronic musical instrument as claimed in claim 8 which further comprises an external tone generator device removably connected to said sending device and wherein said external tone generator device generates a tone on the basis of the music performance information delivered via said sending device.

11. An electronic musical instrument as claimed in claim 8 wherein said receiving device includes a device to which a recording medium storing therein the music performance information of the plurality of tracks is removably attached, and a readout device that reads out the music performance information of the plurality of tracks from said recording medium.

12. A method of reproducing multi-track performance information by use of a tone generating device including an internal tone generator and a removable external tone generator, said method comprising the steps of:

receiving music performance of a plurality of tracks from an external source;

selecting the music performance information of one or more said tracks, from among the music performance of the plurality of tracks, that complies with a predetermined condition;

delivering, to an output, the music performance information of any of the tracks that is not selected by said step of selecting; and generating a tone on the basis of the music performance information of any of the tracks that is selected by said step of selecting.

13. A method as claimed in claim 12 wherein said step of selecting automatically selects the music performance information of one said track of a predetermined track number.

14. A method as claimed in claim 12 wherein said step of selecting selects the music performance information of one said track of a track number designated by a human operator.

15. A machine-readable recording medium containing a group of instructions to cause said machine to implement a method of reproducing multi-track performance information by use of a tone generating device including an internal tone generator and a removable external tone generator, said method comprising the steps of:

receiving music performance of a plurality of tracks from an external source;

selecting the music performance information of one or more said tracks, from among the music performance of the plurality of tracks, that complies with a predetermined condition;

delivering, to an output, the music performance information of any of the tracks that is not selected by said step of selecting; and generating a tone on the basis of the music performance information of any of the tracks that is selected by said step of selecting.

* * * * *